US006904745B2

(12) United States Patent
Badiali et al.

(10) Patent No.: US 6,904,745 B2
(45) Date of Patent: Jun. 14, 2005

(54) THREAD-GUIDING DEVICE FOR OPEN-END SPINNING FRAMES

(75) Inventors: Roberto Badiali, Pordenone (IT); Vittorio Colussi, Cappella Maggiore (IT); Franco Siega Vignut, Maniago (IT)

(73) Assignee: Savio Macchine Tessili S.p.A, Pordenone (IT)

( * ) Notice: Subject to any disclaimer, the term of this patent is extended or adjusted under 35 U.S.C. 154(b) by 113 days.

(21) Appl. No.: 10/378,276

(22) Filed: Mar. 3, 2003

(65) Prior Publication Data

US 2003/0230068 A1 Dec. 18, 2003

(30) Foreign Application Priority Data

Mar. 8, 2002 (IT) ..... MI2002A0500

(51) Int. Cl.[7] ..... B65H 57/28
(52) U.S. Cl. ..... 57/352; 57/400
(58) Field of Search ..... 57/352, 400; 242/481.2; 310/12

(56) References Cited

U.S. PATENT DOCUMENTS 3,853,278 A 12/1974 Berecz et al.
5,973,459 A 10/1999 Itoh
2003/0218091 A1 * 11/2003 Badiali et al. ..... 242/615

FOREIGN PATENT DOCUMENTS

| | | |
|---|---|---|
| DE | 199 21 630 | 11/2000 |
| EP | 0 905 869 | 3/1999 |
| NL | 1 002 036 | 7/1997 |
| WO | WO 02/098777 | 12/2002 |

OTHER PUBLICATIONS

EPO Search Report.

* cited by examiner

*Primary Examiner*—John J. Calvert
*Assistant Examiner*—Shaun R Hurley
(74) *Attorney, Agent, or Firm*—Hedman & Costigan, P.C.

(57) ABSTRACT

Thread-guiding device for collecting spun yarns on bobbins, particularly for open-end spinning frames, constituted by a common thread-guiding rod which carries the thread-guides for the spinning stations, said rod being operated in alternative movement in front of the bobbins being formed by a linear electric motor driven by the control unit of the spinning frame in its alternate backward and forward movement as regards instantaneous speed, amplitude of excursion, and axial coordinates of the ends of the travel of the thread-guiding rod.

11 Claims, 7 Drawing Sheets

46
47
61
60
48
t
41
63
3
22
45
42
64
44
76
46
47
50
70
61
69
49
65d
G
43
41
68
43
22
L
21
65
40
65s
64

THREAD-GUIDING DEVICE FOR OPEN-END SPINNING FRAMES

BACKGROUND OF THE INVENTION

The present invention relates to collecting spun yarn produced or worked by textile machines to be wound on bobbins. In the industrial production of spun yarns it is common practice for them to be collected on an idle tube carried by a bobbin-carrying arm, which rests on a rotating driving roller and takes up the spun yarn coming from a feed element to wind it onto itself. The bobbin is thus formed by pulling and winding the spun yarn on its surface, it being drawn in rotation by the roller underneath on which the bobbin being formed rests. This practice allows the spun yarn to be wound at a substantially constant linear speed, irrespective of the increasing dimensions of the bobbin and depending only on the rotation speed of said driving roller. The spun yarn is wound in spirals onto the rotating bobbin as the pick-up unit is provided with a thread-guiding device which distributes the spun yarn on the outer surface of the bobbin with backward and forward axial motion. In industry, the bobbins may be shaped like a truncated cone or a straight cylinder with substantially flat bases, with the exception of a few specific cases in which the terminal parts of the bobbins are shaped with a pronounced flare.

In the prevalent industrial use of spun yarn in bobbins, downstream working requires the bobbin to be conical in shape, for example when the spun yarn is unwound in an axial direction from the bobbin fixed on creels. This conicity is however slight and restricted to a few degrees of inclination of the generatrix of the cone in relation to its axis, generally between 2° and 6°, except for some specific uses for which "superconic" bobbins are required.

In the case of winding on a winder the most widespread device for distribution of the spun yarn on the surface of the bobbin with axial backward and forward movement consists of a spiral backward and forward groove cut into the surface of the driving roller which causes the spun yarn to perform an axial excursion of a pre-established length, for a pre-established number of turns of the roller and with a pre-established wind ratio. In other words, the yarn winding and spun yarn distribution elements operate according to a fixed speed ratio.

However, in other cases the device for distribution of the yarn on the bobbin is produced with an independent thread-guiding device, moved by its own driving element, with which the frequency of the backward and forward movement, its travel, the length of the spiral wound and the wind ratio, etc. may be modulated time by time and according to need.

Typically, distribution of the spun yarn on the bobbin with modulatable thread-guide is required in open-end spinning frames, for which distribution of the spun yarn on the bobbin with grooved cylinder does not meet the conditions required for efficacious winding on a bobbin of the desired quality. These winding conditions in particular include its wind ratio, the speed and excursion travel, which cannot be maintained at a single pre-established value, as is the case with the grooved cylinder, but must be adapted time by time to the spun yarn being produced and also modulated during production of the bobbin. There are also other impediments to the use of the grooved cylinder, both due to the geometry of the system and to the overall open-end spinning procedure.

In open-end spinning there is a further limiting condition in that the spun yarn is produced at constant linear speed and therefore must be picked up at a speed corresponding to the speed at which it is made available, substantially equal and constant, maintaining it at a moderate tension, while when forming both straight cylindrical and conical bobbins the pick-up speed typically has a pulsating trend.

It must also be borne in mind that, to compensate these pulsations of adjusting tension and path length, the elasticity of the spun yarn could be taken into account only within the limits of a few per cent, also because the yarn is already stressed considerably at the operating speed of current open-end spinning frames.

To explain more clearly the problems dealt with and the technical solutions proposed with the present invention reference is made, in the description below, to pick-up of "open-end" spun yarns on bobbins, provided purely as a non-limiting example, it being explicitly specified that it may be used advantageously to wind spun yarns produced with different spinning technologies on bobbins.

FIG. 1 show the layout of an open-end spinning station 1 with its most significant components. FIG. 1A shows a front view of it while FIG. 1B shows a side view of it.

Proceeding from the bottom upward, it is first encountered the spinning unit 2 and then the pick-up unit 3, the main components of which used to transform staple parallel fibres into the bobbin of wound spun yarn are illustrated briefly below.

The feed strip or staple S is contained in a cylindrical vessel 4 where it is deposited in a double spiral. The staple S is taken up from this and fed to the unit by a feed roller 5 passing through the condenser/funnel conveyor 6. The strip S then passes to the so-called card 7, a small roller equipped with a toothed seal which rotates at high speed to separate and select the fibres of the staple S and convey then by suction to the spinning rotor 8. In this path the short fibres and impurities are separated, so that only the long and cleanest fibres reach the rotor. The impurities are unloaded in to a suction outlet common to all the spinning units.

In the spinning rotor 8, which rotates at a speed $\omega_R$ which reaches 150,000 rpm and over, the fibres are deposited in its peripheral groove through centrifugal force; they are then collected and taken up from here in the form of yarn F.

The fibres are delivered axially from the rotor 8 through the opening of the extractor funnel 9, receiving torsions from rotation of said rotor during the path stretching between its inner groove and said extractor 9, to create the plied yarn F.

The yarn is taken up with an extraction system comprising the extraction roller 11 opposite which is an idle pressure roller 12, generally in elastomeric material and pressed with controlled force to grip the yarn F. This extraction roller 11 is operated at controlled speed and determines the spinning speed or the linear production of spun yard in relation to time. The ratio $V_F/V_S$ between the linear speeds, generally expressed in metres per minute and respectively of yarn extraction and of staple feed with roller 5, determines the drawing ratio between the rotor rotation speed $W_R$ and the yarn extraction speed $V_F$ in metres per minute determines the number of torsions per metre imparted in the spinning rotor.

To prevent uneven wear, the spun yarn extraction system is equipped with a weft-moving control 13, consisting of an auxiliary thread-guide 14 mounted on a longitudinal rod 15 in common with the other spinning units which moves longitudinally on the front of the machine. The motion of the auxiliary thread-guide 14 is a backward and forward movement with the so-called pilgrim step, for reduced travel, generally below 10 mm, and moves the yarn F crosswise to obtain uniform wear on the pressure roller 12, preventing grooves from forming rapidly on its surface.

The yarn F thus produced is fed to the pick-up unit 3, still moving upwards, and encounters a compensator 16, consisting of a straight or barrel-shaped profile onto which the yarn is diverted to compensate or at least decrease the variations in length of the path stretching between the spinning unit 2 and the point in which the yarn F is deposited on the bobbin, due to the axial motion of the thread-guiding device 20 it follows.

The yarn F therefore reaches the thread-guiding device 20, which distributes the yarn on the bobbin being formed moving crosswise with backward and forward motion. This consists essentially of a main thread-guide 21 mounted on a longitudinal rod 22 common with the other spinning units which moves with alternate motion longitudinally on the front of the machine, with an excursion corresponding to the winding travel on the base tube, generally between 120 and 160 mm.

The excursion frequency required is of 100 to 250 forward and backwards strokes per minute, with position precisions in the order of tenths of mm with regard to the axial coordinate of the inversion points.

In prior art different devices are provided to create, adjust and modulate this alternate motion, in frequency, width and axial shift, in order to obtain bobbins that are stable and good quality. These devices use kinematic systems of the connecting rod/crank, four-bar linkage type and so on. In devices of more recent conception, the rod 22 is moved by a large cylinder cam, not shown in the figure for simplicity, driven to rotate at the controlled speed.

Regulation of the cylinder cam rotation speed allows modification of the frequency of the strokes of the thread-guiding devices 20 and the wind ratio of the spun yarn on the bobbin. A further possibility is also provided of adding a second movement of axial modulation to move the motion inversion point of the thread-guides 21 to decrease phenomena of unevenness at the two ends of the bobbin, distributing them over a greater axial extension.

The thread-guide 21 is extremely near the surface of the bobbin being formed. The bobbin 25 is held by the bobbin-carrying arm 26 provided with two openable idle tailstocks 27 which come into contact with the base tube 28 of the bobbin. The bobbin being formed 25 rests on its driving roller or pick-up roller 29. This pick-up roller is provided with one or more drawing bands 30 in a material with a high friction coefficient, generally rubber. In the case of pick-up on conical bobbins these bands make it possible to establish the drive ratio between bobbin and roller, while in the case of cylindrical bobbins they allow a balanced driving torque to be transmitted to the bobbin 25. The bobbin 25 being formed increases progressively in size and weight. The contact pressure of the bobbin on its pick-up roller 29 has a considerable influence on the density of said bobbin. The contact pressure is therefore controlled with a counterweighing system which acts to keep the contact pressure at a determined value, compensating the effects of its increase.

The use of thread-guiding devices 20 with independent action has noteworthy advantages, such as being able to operate with the exact wind ratio required by the production in progress, to control and avoid ribboning on the bobbin, to obtain stable and well-formed bobbins, but still does not solve all winding problems.

Further problems still encountered in winding spun yarn on a bobbin with distribution by means of independent thread-guiding devices 20 are essentially caused by phenomena, the details of which shall be described below.

One of these concerns distribution of the spun yarn on the generatrix of the bobbin—whether conical or cylindrical—with a thread-guiding means with alternate excursion between the two ends of the winding. This excursion periodically lengthens and shortens the length of the stretch of yarn running between the spinning unit 2 and the point of pick-up on the bobbin 25. This is minimum when the thread-guide is halfway through its travel, and maximum when the thread-guide is at the ends of its travel. This variation therefore causes a first pulsation in the take-up speed of the yarn, as at all times it is necessary to attain from below the algebraic sum of the length of yarn wound on the bobbin with the periodic variation in length—positive and negative—of the path that joins the spinning unit which feeds the yarn F at constant speed and the pick-up element which takes it up a pulsed speed and hence with pulsed tension.

If the bobbin 25 is conical, the phenomena of pick-up speed pulsation is combined with an additional speed pulsation and tension caused by the conical shape of the bobbin. When it is wound on the part of the bobbin 25 with the largest diameter, the yarn F is taken up at a higher speed than the speed at which the yarn F is fed from the spinning unit 2 and is therefore stretched more; instead, when the yarn F is wound on the part of the bobbin with the smallest diameter the situation is reversed: the yarn F is slack as it is taken up at a lower speed than the feed speed of the spinning unit 2.

The average pick-up speed is maintained coinciding with the speed at which the yarn is fed by the rotor 8, or just above this to obtain moderate additional draw and ensure the yarn is always stretched. The overall effect deriving from these tension and speed pulsations on the yarn F being wound is essentially of greater density and compactness of the bobbin 25 in its end points, where tension is greater. The variation in the tension of the yarn F and the consequent more or less dense and compact zones is only partially compensated by the compensator 16, which alleviates the phenomenon but does not eliminate it, and in any case with a certain shift due to the friction of the yarn which runs crosswise on its diverter profile.

A second problem in pick-up of the spun yarn F with the independent thread-guiding device 20 derives from the mass of the thread-guides 21, their rod 22 and their alternate motion control device. The assembly has a significant mass, therefore causing limits to the admissible braking and acceleration values, as well as the minimum braking and acceleration times and spaces. The times and spaces for inversion of motion must in any case come within the order of milliseconds and millimeters respectively, to provide the bobbin with the quality required for the subsequent use, as regards shape and mechanical stability.

In prior art devices which employ the control with cylinder cam and, due to these limits, in the two ends of the stroke where motion is inverted, the profile of the cylinder cam have a smooth radius to avoid impacts, vibrations and damage to the overall system. Consequently, the speed of the thread-guide 21 also has a radiused trend—generally sinusoidal—compared with the axial coordinate while in the remaining part of its stroke the thread-guide is controlled at a constant speed, or at a constant wind ratio. In the end stretches they therefore have a lower average speed and a longer stay time, compared with the intermediate stretch of travel.

The first effect of this longer stay time is that a greater quantity of yarn F is deposited at the two bases of the bobbin, where the yarn being wound is also stretched more tightly. This causes increased compactness at the ends and a further increase in unevenness forming protrusions where the bobbin is already denser. Two harder terminal bulges are formed giving the bobbin an M-shaped profile; this uneven winding causes noteworthy drawbacks in the use and further working of the spun yarn wound on said uneven bobbin.

This winding defect is not permitted for some uses of the spun yarn; in some cases, therefore, the bobbin produced in the open-end spinning frame must be unwound and rewound more evenly with an additional operation and cost.

BRIEF SUMMARY OF THE INVENTION

The object of the present invention is to produce a device to distribute the spun yarn on bobbins being wound which overcomes the drawbacks of thread-guiding devices available at the state of the art and makes it possible to obtain bobbins with more regular density, shape and stability.

The device according to the invention is defined, in its essential components, in the first claim while its variants and preferred embodiments are specified and defined in the dependent claims.

To illustrate the characteristics and advantages of the present invention in greater detail, it shall now be described with reference to some typical embodiments indicated in FIGS. 1 to 4, purely as a non-limiting example.

Said figures relate to an embodiment of the thread-guiding device according to the invention to distribute yarn on the bobbin being wound, showing only the system to move the longitudinal bar 22 which carries the thread-guides 21 supplying the spinning units aligned along a front of the spinning frame, to illustrate the characteristics and benefits of the present invention.

BRIEF DESCRIPTION OF THE SEVERAL VIEWS OF THE DRAWINGS

The FIG. 2 show an embodiment of the thread-guiding device driven by a linear motor, for example of the magnetic type. FIG. 2A shows its front view, FIG. 2B shows its sectional side view, while

FIG. 3 shows an alternative embodiment of the directional guide and support system for the slider 41 of the linear motor: in particular, FIG. 3A shows the front view, while

DETAILED DESCRIPTION OF THE INVENTION

Figure 1A:
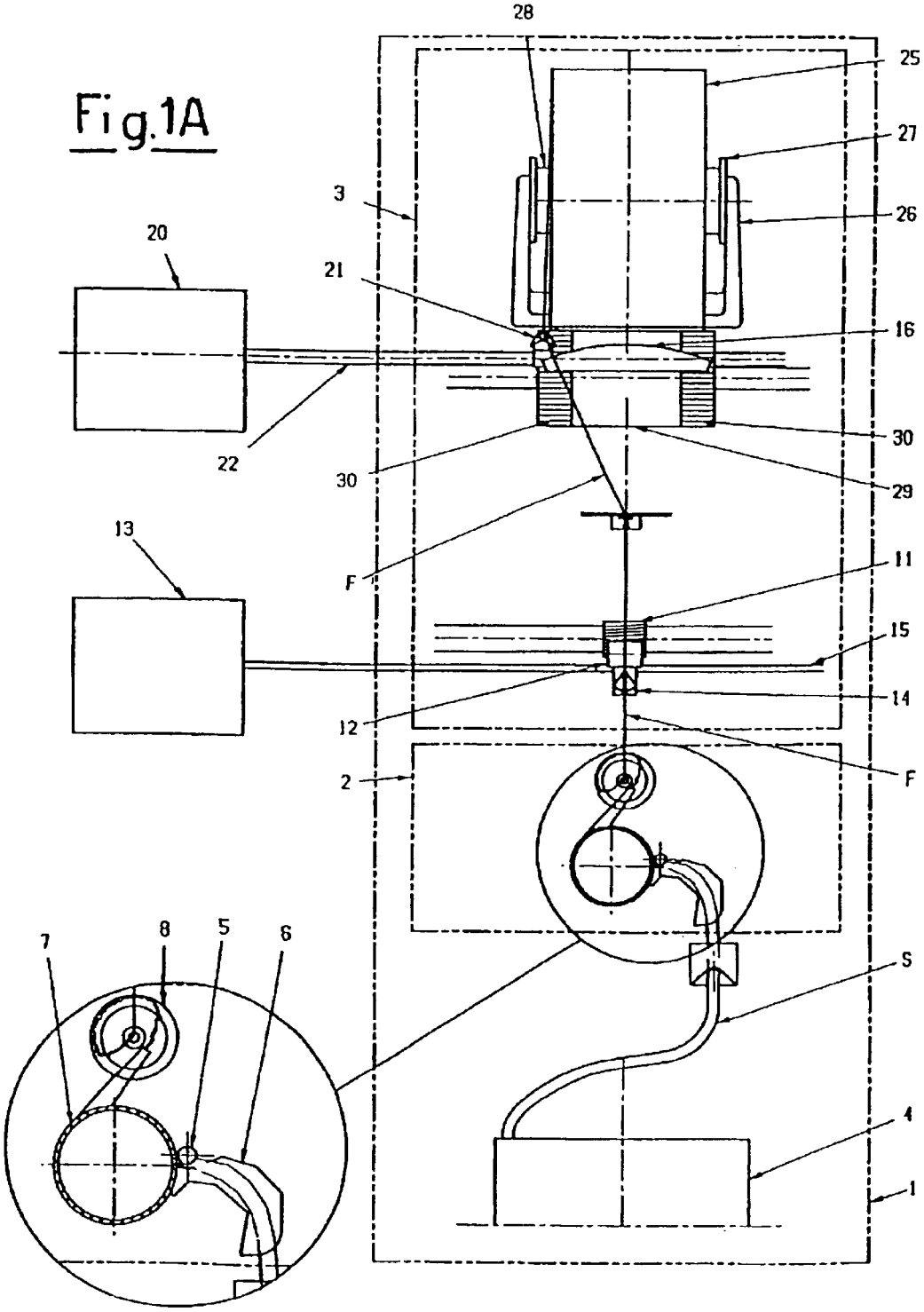
PRIOR ART Fig.1A
FIGS. 1A and 1B schematically show, in a front and side view respectively, a typical embodiment of an open-end spinning unit essentially to illustrate the technical problem underlying the present invention.
Figure 1B:
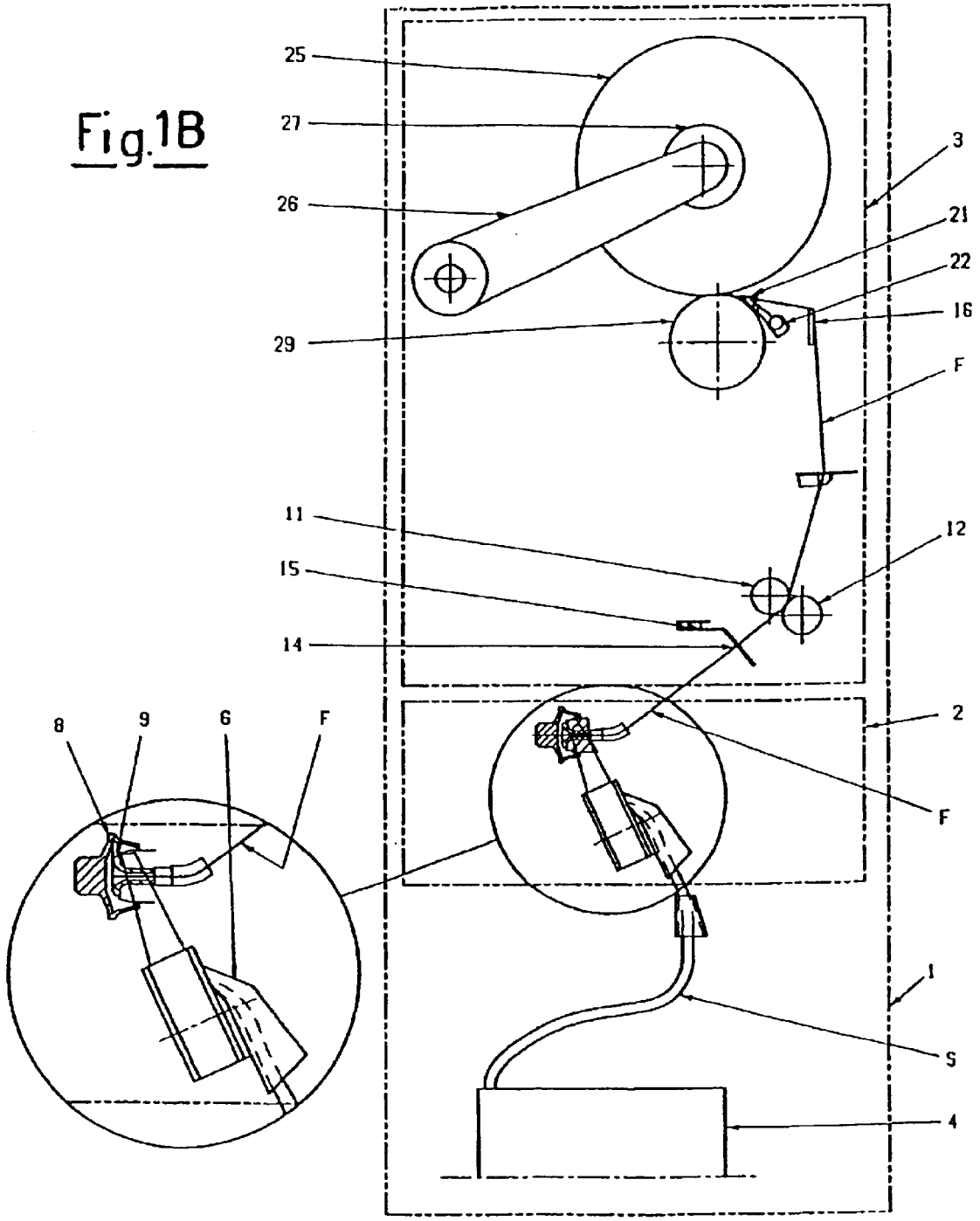
PRIOR ART Fig.1B
Figures 2A, 2B:
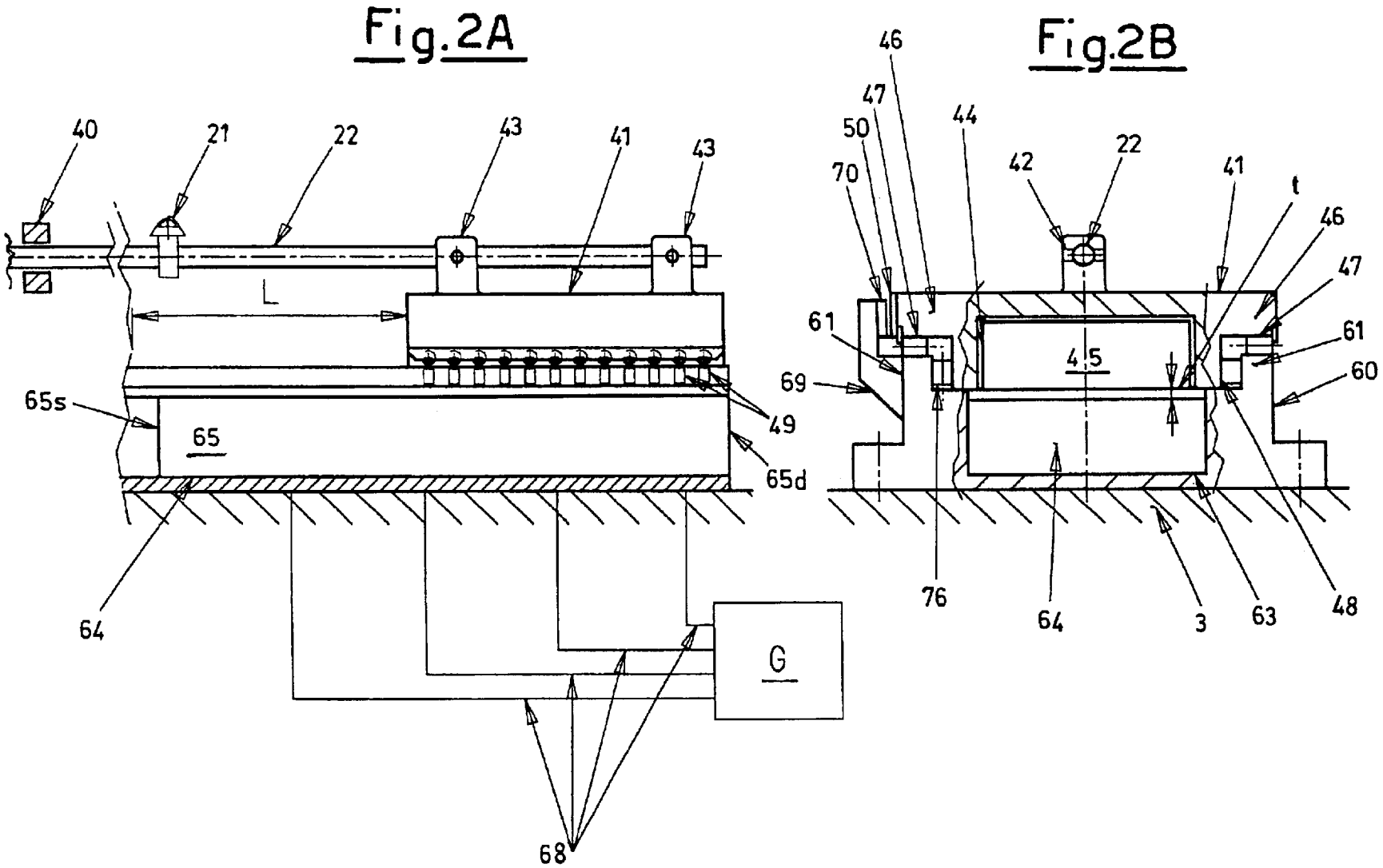

FIGS. 2A, B show the thread-guiding rod 22, with thread-guide 21 with span corresponding to the span of the spinning unit 2 in FIGS. 1A and 1B. The moving equipment assembly of the thread-guiding device is produced with maximum savings in weight, directing choices of structures and materials which guarantee high rigidity and precision of movement with the lowest possible weight, for example employing composite materials and ceramics for the rods and thread-guides. The precision of movement and slenderness of the structure therefore require guides 40 aligned along the front of the machine, positioned for example every two spinning units, only one of which is shown to simplify the drawing. These guides 40 are provided with low friction and wear-resistant surfaces or facings in contact with the rod 22. The rod or bar 22 is made to move alternately to translate its thread-guides 21 in the front of the bobbins being formed by the alternate motion of a slider 41 connected integrally to the thread-guide rod 22 with a connection per se known, such as with through pins 42, which connect the protrusions 43 of the slider 41 with corresponding holes in the ends of the rod 22.

The slider 41 contains internally, in a corresponding cavity 44 with longitudinal trend, a magnetic bar body 45, for example a permanent magnet, integral with it, positioned in an axial direction and provided with a plurality of alternate positive and negative polarities which are currently indicated as north and south, N and S. This magnetic bar body 45 is illustrated below with reference to FIG. 2C. The slider 41 is also provided with projections and directional bearings to control its alternate horizontal motion in relation to the stator 60 which drives and supports it. The body of the slider 41 has an enlarged T section and rests with its outer wings 46 on the two side projections 61 of the stator 60 which act as a track for motion of the slider 41. In the embodiment shown in FIG. 2, the slider 41 is equipped with a series of rollers with horizontal axis, or equivalent rolling bodies 47, supported by a suitable retaining frame, which allows mutual horizontal translation of the slider 41 and stator 60 with rolling friction, maintaining the facing surfaces of slider and stator at a pre-established and rigorously controlled distance. The space between the two elements is currently called "gap" and, generally, the distance which separates them is around 0.5 to 1 mm.

On the two opposite parts 48 of the T-shaped stem, the slider body 41 is similarly equipped with a series of directional bearings 49 with vertical rollers, to maintain the body of the slider centred in relation to the supporting tracks 61, and to keep the thread-guide rod 22 correctly aligned with its guides 40 during its backward and forward motion.

Figure 2C:
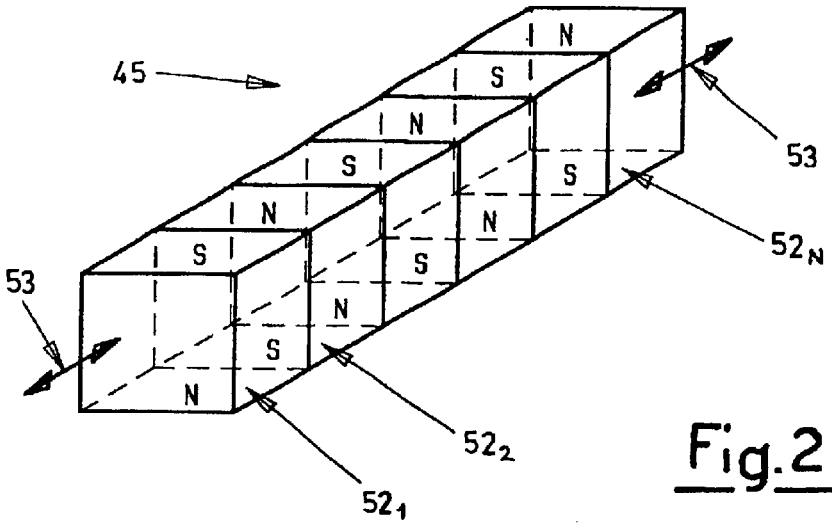
FIGS. 2C, 2D and 2E show constructional details of the device.

As illustrated as an example in the perspective view in FIG. 2C, the magnetic bar body 45 is electrically constituted by a magnetic body with a rectangular section, obtained by connecting a plurality of permanent magnets $\mathbf{52}_1$, $\mathbf{52}_2$, . . . facing one another with their side faces, alternating the N and S polarities on their upper and lower faces. The direction of alternate motion in the two directions which moves the slider is indicated by the arrow 53. The magnetic field of the single magnets constituting the bar 45 of the slider 41 is closes through the stator. The number of magnets 52 which are used to constitute the magnetic bar 45 varies as a function of the characteristics of force exerted, speed, and so on, and is generally between 2 and 10. The layout of the pack of magnets 52 may be either orthogonal or inclined in relation to the direction of motion, thus regulating the precision and so-called roughness of its operation.

The body of the stator 60 is connected integrally with the structure of the pick-up unit 3 wit means per se known, for example by screw fixing. A longitudinal groove 63 is produced in its innermost part in which the electromagnetic body 64 is housed axially, energized to move the slider 41, according to the base layout of the linear motor adapted to the specific purpose attained with the present invention. An example of the structure of said electromagnetic body is illustrated with reference to FIG. 2D.

The energized electromagnetic body 64 is constituted by a bar core 65 of ferromagnetic material with a polygonal section, for example rectangular, around which a plurality of windings energized electromagnetically are positioned between 65*d* and 65*s*, to provide the surface of the bar 65 facing the slider 41 with a north and south polarity sequence, indicated with N and S, or alternately positive or negative polarity which move axially forward and backward so as to attract or repel the facing polarities of the slider 41 and thus make it move to the right or to the left, according to the direction and the sequence of the energizing electrical current supplied to the windings.

Figure 2D:
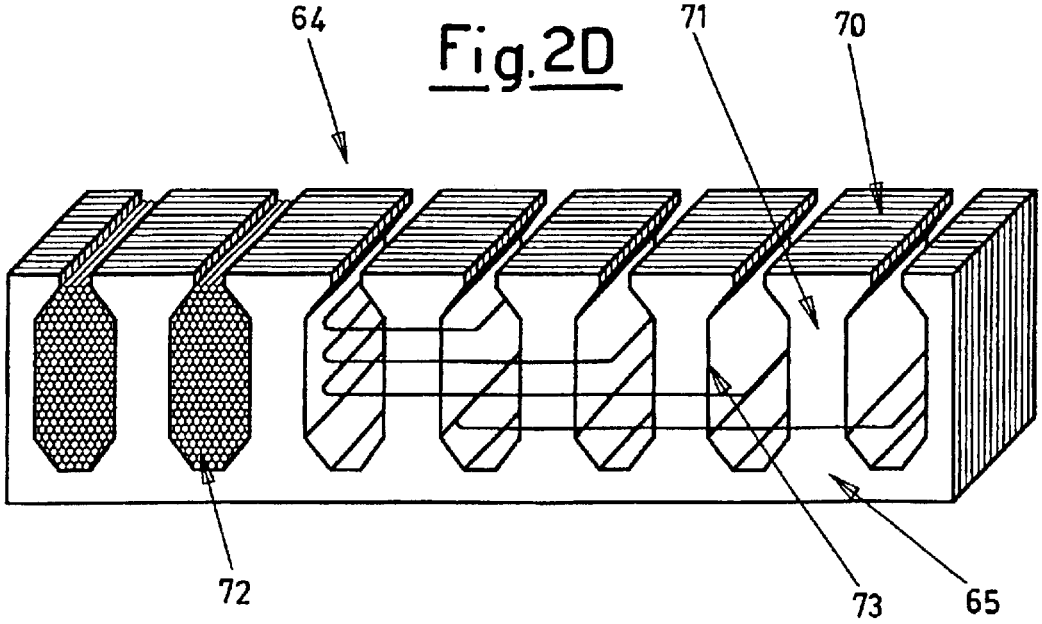

In the example of embodiment in FIG. 2D the bar 65 of the stator 60 is shown in a perspective view. The bar 65 is electrically constituted by a lamination stack with slots and windings which correspond fully with those of a normal rotary electric motor, with its lamination winding stack open and extended. In FIG. 2D the bar 65 comprises a lamination stack 70 the length of the entire bar 65 with repetitive profile constituted by a series of Ts 71, side by side and joined at their base, to insert the windings 72 in their slots 73 corresponding with the stems of the Ts of the lamination stack.

The number of slots 73 for the energizing windings 72 of the bar core 65 is greater than the number of magnets 52 and, in general, is between 6 and 30.

The bar 65 of the lamination stack may also be overturned to place the openings of the slots 73 in the lower face and with the smooth and continuous face of the lamination stack 70 facing the slider 41.

The windings 72 are therefore toroidal in shape extending horizontally and are energized in sequence with currents that change in direction with regulated frequency, to produce a series of N and S polarities which move axially and with them draw in movement the N and S polarities of the bar 45 with the slider 41.

The windings 72 may each be wound around only one stem of the Ts, or differentiating the windings according to different lengths around one or more stems of the Ts 71, as shown in FIG. 2D. With this expedient it is possible to use power supplies with various phases with a more regular trend of the moving magnetic field produced.

The magnetic field generated in the bar 65 of the stator 60 is hence extremely regular and slides easily in both directions.

The sliding speed of the magnetic field is regulated by varying the frequency with which the direction of the energizing current in the windings changes. Generally, the length of the stator corresponds at least to the length of the slider with an increase in its travel, according to the height of bobbin required.

Generally, energizing of the bar 65 may also be produced with direct current and periodically switching the connection of the N/S polarity of the generator.

Operation of the thread-guide is obtained by energizing the windings of the series with an inverse frequency of the energizing current which causes the N and S polarity frequency of the bar 65 to slide forward and backward so as to draw the slider with it.

Figure 2E:
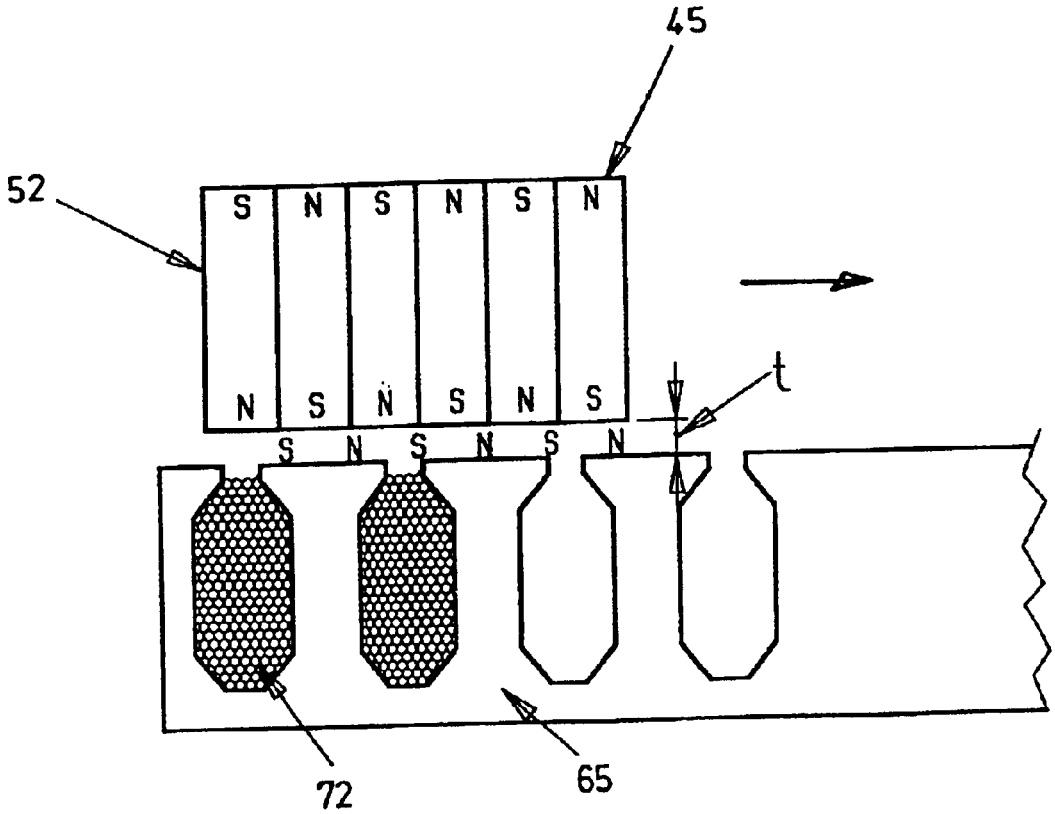

The operating layout of the linear motor device according to the present invention is described with reference to the schematic representation in FIG. 2E.

The magnetic core which forms the bar 45 of the slider is positioned above the energized electromagnetic bar 65 of the stator with interposition of the gap t. The different alternate N/S polarities of the permanent magnets 52 of the magnetic bar 45 positioned side by side are shown. The lower part represents the bar of the stator, in which modulations of the currents supplied to the windings produce a magnetic field wit axial movement, which precedes the field of the slider angularly offset (generally by 90° e) attracting it with its movement. In this way the S-N-S-N . . . respectively of the stator 65, which however continue to invert their positions, while the slider translates by one step, to create the translation force of the motor.

Modulation of the currents in the windings moves the slider, determining acceleration, braking and inversion of motion, and also allows control of the mutual position between stator and slider.

By regulating times, intensity and direction of the energizing currents in the windings 72, the control unit G obtains the desired backward and forward motion as regards amplitude and travel inversion points, speed and accelerations of the thread-guide rod 22. To simplify the drawing, the electrical connections of the windings with the control unit G are indicated with lines 68.

For management of the alternate motion control of the thread-guide rod 22, by the control unit G of the spinning frame, reading of the relative position between slider 41 and stator 60 in the axial direction of motion is delegated to a conventional positioning sensor per se known, equipped with the suitable precision and reading promptitude. This reading is transmitted to the control unit G which processes it and produces the consequent energizing commands. For example, in the embodiment illustrated in FIG. 2B the stator 60 is equipped on an extension 69 of its left side with an optical sensor 70, currently indicated as "encoder", which reads the axial coordinate of an optical scale of reference 50 positioned instead on the side of the left wing 46 of the slider 41. Control of energizing of the windings 72 is managed by the control unit G on the basis of moment by moment reading of the position of the optical scale of reference 50 in relation to the encoder 70.

For this purpose, the control unit G of the spinning frame is provided with relative means for said control of energizing on the basis of reading by the encoder.

The length of the energized electromagnetic body 64 available for axial excursion of the slider 41 is of a size that allows parallel excursion of the rod 22 to take place without drawbacks for all the foreseeable strokes L for the range of heights of bobbin designed and required for the pick-up section 3 of the spinning stations.

Alternate linear motion drive of the thread-guiding rod 22 is due to the parallel and corresponding alternate motion of the slider 41 which is controlled in alternate excursions by the control unit G of the spinning frame. It therefore contains the instructions and software required to command and control alternate axial movement as regards instantaneous speed, amplitude of axial excursion, coordinates of the ends of its travel, and so on.

According to a preferred embodiment of the invention the linear electric motor, constituted by the slider 41 and the stator 60, is obtained with a core of magnetic material 45 based on a mixture of rare earths which, with the same magnetic attraction/repulsion force, allow a considerable reduction in the weights of the moving equipment and their inertias, compared with traditional ferrous magnets.

Figure 3B:
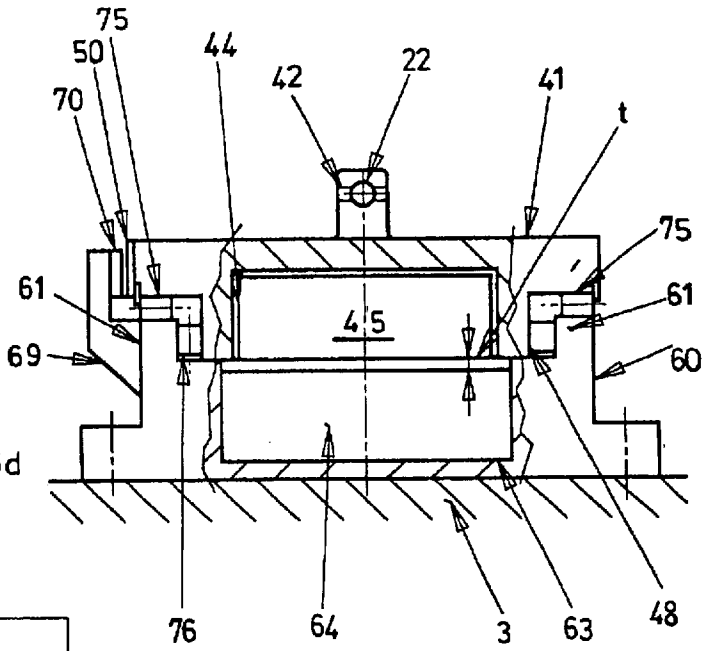
FIG. 3B shows the sectional side view.
Figure 3A:
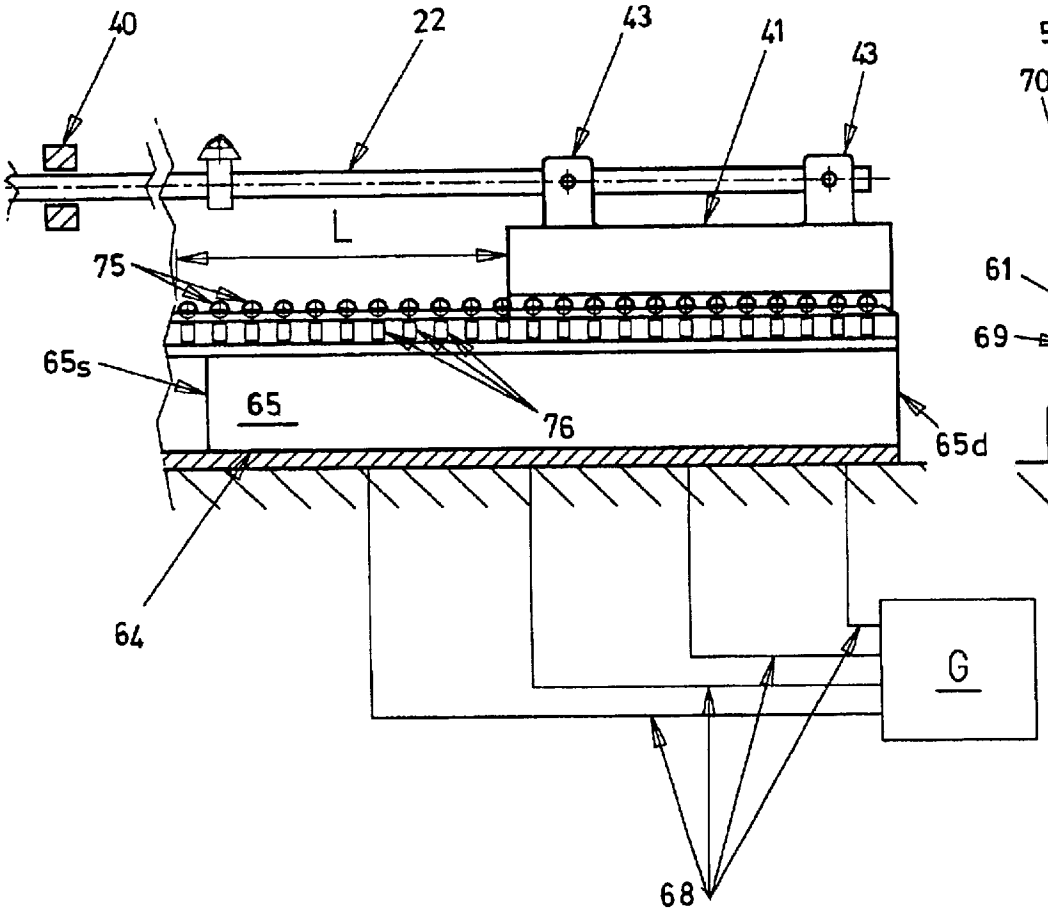

The alternative embodiment in FIGS. 3A and 3B shows the same assembly of thread-guiding rod 22 with thread-guides 21 and guides 40 already described with reference to FIGS. 2A, B.

According to the embodiment shown in FIG. 3, it is the upper part of the projections or tracks 61 of the stator 60 to be equipped for its entire length with a series of rollers 75 with horizontal axis, or equivalent rolling bodies, carried by a suitable retaining element which allows the lower part to project to allow the slider 41 to rest and translate horizontally on the stator 60 with rolling friction, guaranteeing a strictly controlled distance between the two bodies at all times.

Similarly, fitted on the two opposite sides 48 of the stem of the T, for the entire length of the two vertical inner walls of the projections 61 is a frame to support a series of directional rollers 76 with vertical axis, again to maintain the body of the slider 41 and the thread-guiding rod 22 correctly aligned with its guides 40 in its backward and forward motion, sliding with rolling friction in relation to the stator 60.

Compared with the previous embodiment, the alternative embodiment shown in FIGS. 3A, B allows a significant reduction in the masses moved by alternate motion, thus decreasing the inertia forces deriving from sudden braking and acceleration in the points where motion is inverted.

The alternative embodiment shown in FIG. 4 concerns the layout of the linear drive motor, while the mechanical layout to guide and support the slider and stator to guide the thread-guiding rod 22 assembly does not differ from the one already described with reference to the previous FIGS. 2A, B, C, D and 3A, B.

Figure 4:
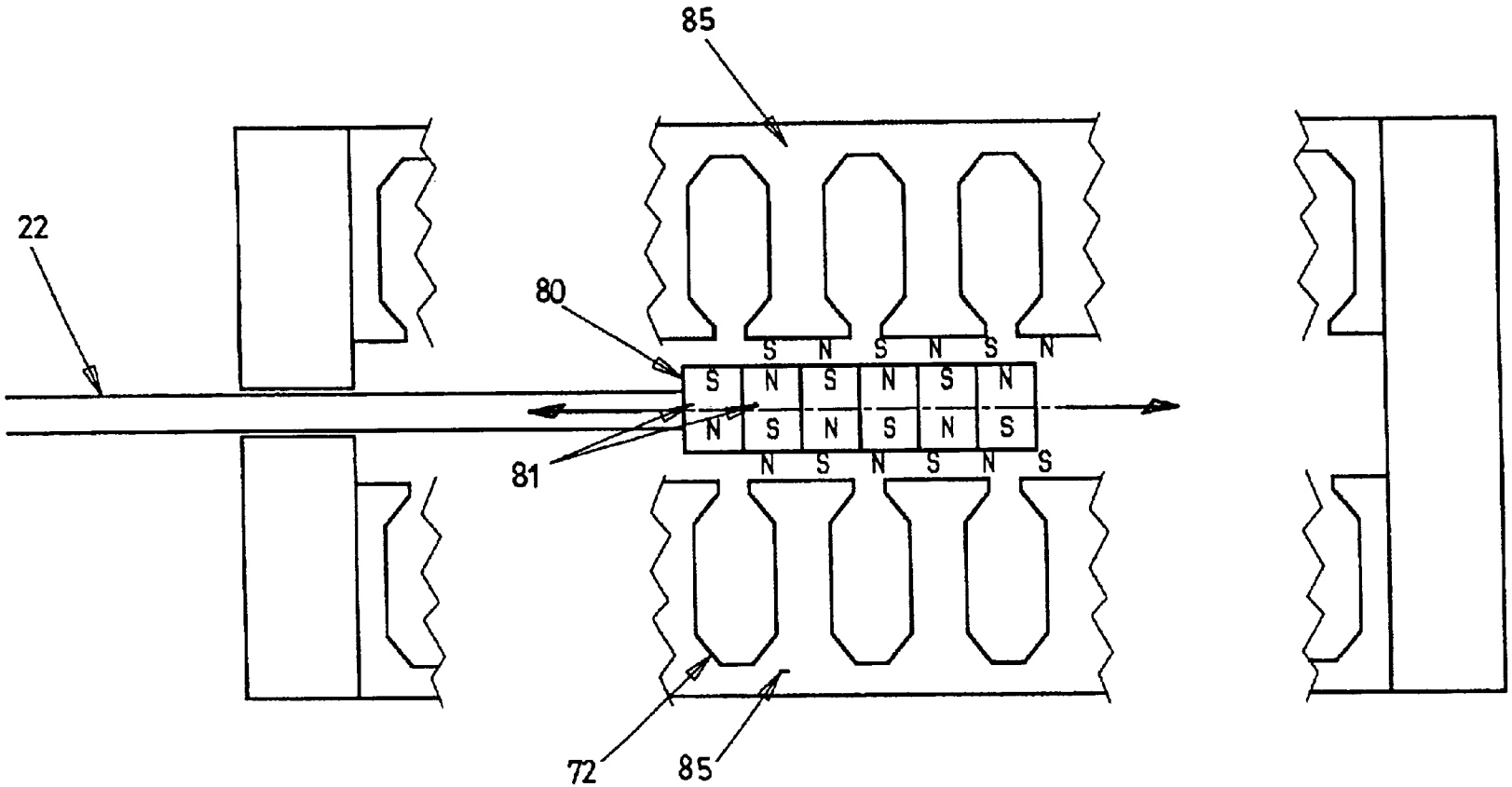
FIG. 4 shows an alternative embodiment of the linear driving motor, in which there are no substantial variations in the elements of the mechanical guide and support layout of the slider.

According to the embodiment shown in FIG. 4, the slider 80 is connected integrally with the thread-guide bar 22 and is preferably produced with a magnetic bar constituted by a composite sandwich of permanent magnets 81 with light connection materials, such as glass fibres, stainless steel sheets and so on, positioned similarly to those of the bar 45 according to the FIG. 2C. The slider 80 is positioned with its N-S-N-S . . . polarities directly facing two opposite stators 85 with structure and windings entirely analogous to those illustrated with reference to FIG. 2D.

The two opposite stators may be energized with parallel connections to produce on their surfaces facing the two opposite faces of the slider 80 a series of N and S polarities which move correspondingly and axially to attract with it the opposite N and S polarities of the magnetic bar of the slider 80.

In correspondence with the two side faces of the slider 80 both the position sensor and the elements to support and guide the slider are positioned, entirely analogous to those illustrated with reference to FIGS. 2A, B and 3A, B; these are not shown in FIG. 4 to simplify the drawing. This preferred embodiment of the invention makes it possible to fully satisfy the requirements of dynamic performance of the thread-guide greatly reducing residual magnetic attraction, with the elimination of ferrous materials throughout the body of the slider. This embodiment also allows balance of the forces of attraction between the slider and the stators positioned opposite, which greatly reduces the load on the bearings to guide and support the slider. These forces of attraction may exceed the useful forces of axial attraction even by one order.

The thread-guiding device according to the present invention has substantial improvements compared with prior art devices. Of these, at least the following improvements deserve a mention. The drive control with linear motor controlled by the control unit of the open-end spinning frame allows modulation of the bend ratio in relation to the pick-up speed so as to prevent negative phenomena of ribboning and uneven density and winding of the body of the bobbin. It also allows precision winding to be obtained.

It is important that a mechanical system to convert rotatory motion of the conventional electric motor in alternate rectilinear motion is not required, as is the case in traditional systems. This allows elimination of their most critical components, such as the motor bearings and the mechanical connection between rotary motor and thread-guide in alternate rectilinear movement. In the device according to the invention the masses moved by alternate motion, with the sudden accelerations and decelerations required, are considerably reduced with improvements in the performances obtained.

The linear electric motor is subjected to less stress as the forces exerted between its static part and the part in translating alternate motion are forces caused by magnetic fields, with fewer eddy currents.

In general, on open-end spinning frames bobbins are normally produced by winding with considerably different degrees of feed and dimensions. Electrical control of the linear motor allows a large variation of modulations in the motion of the thread-guide rod 22 and avoids ribboning phenomena even when working with bobbins of various degrees of feed, or started at different times. Linear motor drive makes it possible both to vary the length of travel and, with a constant length of the thread-guide travel, to modulate the motion inversion points. This makes it possible to reduce the M profile of the bobbin, axially distributing on a discrete stretch the peak of increase in density and compactness which it produces at the two bases of the bobbin 25.

The effect of the M-shaped terminal bulges of the side profile of the bobbin may be further flattened, by getting the linear motor to make centred axial excursions of reduced length at discrete intervals of time; this makes it possible to fill the distance between the terminal bulges with centred and shorter windings; these bulges are inevitably caused by the increased deposit of yarn in points in which the instantaneous speed of the thread-guide is lower.

A further possibility to improve the quality of the winding may be obtained by modulating the wind ratio in the middle stretch of the travel, decreasing the linear speed of the thread-guide in the central stretch of its travel, controlling energizings of the linear motor or modulating the magnetization intensity of the magnetic body fitted in the slider 41.

The electronic control system of the thread-guide according to the invention is capable of optimally performing all the functions required of the mechanical system generally employed on open-end spinning frames of the most recent conception, but with noteworthy advantages compared to this, the most important points of which are set forth below.

With modulation of the electric energizings imparted to the linear motor constituted by the slider 41 and by the stator 60 in the thread-guiding device according to the present invention the following are obtained:

- backward and forward movement of the thread-guiding rod common to the entire machine front with extremely low weight equipment. In the conventional mechanical system the same movement is obtained with a heavy and complicated assembly, based on a rotary cylindrical cam with a groove to which a sliding guide moved by horizontal motion is connected;
- a range of possible modulations of the alternate motion to avoid ribboning. In the conventional mechanical system modulation requires overlapping a sinusoidal motion over -a basic uniform motion, obtained with an epicyclical mechanism, or with the disturbance of said basic motion with coupling/uncoupling devices, with effects not strictly controlled for the various feed conditions of the bobbins;

modulation both of the travel and of the axial motion inversion points of the thread-guide to prevent or reduce the formation of denser bulges at the ends of the bobbin. The conventional mechanical system can only reduce the phenomenon with modest axial translations of the thread-guide control.

In addition to these functions of the conventional thread-guide, the electronic control system of the thread-guide according to the invention is capable of producing further performances and of solving recurrent problems in the open-end spinning frame with mechanically controlled thread-guide, especially when forming bobbins at different degrees of feed on the machine.

Modulated control of the linear motor energizings allows the thread-guiding device according to the invention to produce precision bobbins in layers, also working on staggered bobbins, that is without the need for all the bobbins on the machine to be of the same diameter and length, or with the same degree of feed with all the bobbins having been started and terminated at the same time. This possibility is not offered by conventional mechanical systems. The procedure consists in winding on the bobbin layers of the same length, produced with a constant pitch and with a wind ratio that decreases as the diameter increases. At the end of each layer the initial wind ratio is returned to and another layer is deposited and so on. In this way very dense and uniform bobbins are obtained, similar to those of the precision bobbins, even when working with bobbins with staggered feed. The only difference between the bobbins is due to the fact that, at the start of a new bobbin, the first layer is in a random condition between the start and end of the single layer but, by operating with a large number of layers to constitute the bobbin, this circumstance has no influence whatsoever on the quality or appearance of the finished bobbin.

What is claimed is:

1. Thread-guiding device for collecting spun yarns on bobbins, particularly for open-end spinning frames, comprising a thread-guiding rod (22) which carries thread-guides (21), fixed and spaced apart with a span corresponding to a span of spinning stations (1), positioned on a series of guides (40) and driven in alternate movement to translate its thread-guides (21) in front of a bobbin being formed by the alternate motion of a driving means (41), wherein said driving means is a slider (41, 80) of a linear electric motor, comprising a bar body (45, 80) integral with it, positioned in an axial direction, said bar body (45, 80) is obtained by connecting a plurality of permanent magnets (52) facing one another with their side faces, alternating the positive and negative (N) and (S) polarities on their upper and lower faces, which is moved in alternate translating motion by energizing a variable magnetic field produced in a stator (60, 85) comprising a bar body (65) energized with windings (72) with electromagnetic spirals to provide it surface facing said slider (41) with a sequence of (N) and (S) polarities, or alternately positive or negative polarities which mover axially forward and backward so as to attract or repel the facing (N) and (S) polarities of the slider (41) to move the slider (41) according to the direction of the electric energizing current which is supplied in sequence to said windings (72) and which is controlled by a control unit (G) of said spinning frame.

2. Thread-guiding device as claimed in claim 1, wherein said control unit (G) of the spinning frame, to read the relative position between slider (41, 80) and stator (60, 85) in the axial coordinate of an optical scale of reference (50), said control unit (G) of the spinning frame being equipped with means for said control of energizing of said stator of said linear electric motor on the basis of an encoder reading, so that management of control of energizing of said stator (60, 85) is performed by said control unit (G) on the basis of the moment by moment reading of the position of said optical scale of reference (50) in relation to an encoder (70).

3. Thread-guiding device as claimed in claim 2, wherein said encoder (70) is positioned on the said stator (60, 85), while said optical scale of reference (50) positioned on said slider (41, 80).

4. Thread-guiding device as claimed in claim 3, wherein an energized electromagnetic body (64) comprises a bar core (65) with a series of slots (73) to insert said windings (72) connected with connections (68) to said control unit (G) of said spinning frame to energize them in sequence, alternating the direction of the energizing current to move said slider (41) forward and backward.

5. Thread-guiding device as claimed in claim 4, wherein a number of slots (73) for said windings (72) to energize said bar (65) is between 6 and 30.

6. Thread-guiding device as claimed in claim 5, wherein said magnetic bar body (45, 80) is a permanent magnet based on rare earths.

7. Thread-guiding device as claimed in claim 1, wherein said slider (41, 80) is equipped with rolling bodies (47) with horizontal axis, which allow mutual horizontal translation of slider (41, 80) and stator (60, 85) with rolling friction, maintaining a facing surfaces of slider and stator at a pre-established and controlled distance.

8. Thread-guiding device as claimed in claim 1, wherein said slider (41, 80) is equipped with a series of directional bearings (49) with vertical rollers, to maintain the body of said slider centered in relation to a side projections (61) of said stator (60, 85) which act as a track for motion of said slider (41, 80).

9. Thread-guiding device as claimed in claim 8, wherein an upper part of said side projections (61) of said stator (60, 85) is equipped for its entire length with a series of rolling bodies (75) with horizontal axis to allow said slider (41, 80) to rest and translate horizontally on said stator (60, 85) with rolling friction, guaranteeing a strictly controlled distance between said slider (41, 80) and said stator (60, 85) at all times.

10. Thread-guiding device as claimed in claim 1, wherein a series of directional rollers (76) with vertical axis are positioned along inner vertical walls of said projection (61), to maintain the body of said slider (41, 80) centered in relation to said stator (60, 85), sliding with rolling friction.

11. Thread-guiding device as claimed in claim 1, wherein said slider (80) being integral with said thread-guiding bar (22) is produced with a bar of permanent magnets (81) and is positioned with its polarities (N-S-N-S . . . ) directly facing two opposite stators (85) with windings (72) energized to produce on their surfaces facing the two opposite faces of said slider (80) a series of (N) and (S) polarities which move correspondingly and axially to attract with it the opposite (N) and (S) polarity of the magnetic bar of the slider (80).

* * * * *